United States Patent [19]

Kato et al.

[11] 4,380,196

[45] Apr. 19, 1983

[54] PLATE FOR LITHOGRAPHY OR OFFSET PRINTING

[75] Inventors: Yoshiaki Kato, Neyagawa; Akira Fushida, Suita; Yasuo Ueda, Kobe; Yasusuke Tohi, Sakai; Tatsuo Aizawa, Osaka, all of Japan

[73] Assignee: Mita Industrial Company Limited, Osaka, Japan

[21] Appl. No.: 788,088

[22] Filed: Apr. 15, 1977

[30] Foreign Application Priority Data

Apr. 26, 1976 [JP] Japan ..... 51-46515

[51] Int. Cl.[3] ..... B41N 1/14

[52] U.S. Cl. ..... 101/453; 101/466; 101/401.1

[58] Field of Search ..... 101/466, 453, 401.1

[56] References Cited

U.S. PATENT DOCUMENTS

| | | | |
|---|---|---|---|
| 2,807,233 | 9/1957 | Fitch | 118/637 |
| 2,819,963 | 1/1958 | Hamm | 96/94 |
| 2,855,324 | 10/1958 | Van Dorn | 117/25 |
| 3,096,260 | 7/1963 | Mail | 101/426 |
| 3,157,500 | 11/1964 | Abbott et al. | 96/28 |
| 3,161,544 | 12/1964 | Berry | 118/637 |
| 3,363,555 | 1/1968 | Olden | 101/426 |
| 3,441,938 | 4/1969 | Markgraf | 346/1 |
| 3,565,612 | 2/1971 | Clark | 96/1 |
| 3,650,797 | 3/1972 | Tomanek | 117/17.5 |
| 3,951,063 | 4/1976 | Schank | 101/466 |

*Primary Examiner*—Clyde I. Coughenour
*Attorney, Agent, or Firm*—Sherman & Shalloway

[57] ABSTRACT

A plate for lithography or offset printing comprising a flexible substrate and a water-resistant coating layer formed on the flexible substrate, said water-resistant coating layer being composed of a water-insoluble resin binder and an inorganic pigment dispersed in said binder, and the water-resistant coating layer including an oleophilic ink-supporting portion composed of particles consisting essentially of at least one member selected from triiron tetroxide and γ-type diiron trioxide, the particles being embedded in at least a part of the surface of the coating layer, and an etched hydrophilic ink-repelling portion composed of the inorganic pigment.

5 Claims, 6 Drawing Figures

PLATE FOR LITHOGRAPHY OR OFFSET PRINTING

BACKGROUND OF THE INVENTION (1) Field of the Invention

This invention relates to a plate for lithography or offset printing and a process for the preparation thereof. More particularly, the invention relates to a plate for lithography or offset printing having a high resolving power and a high image density in combination and a process for the preparation thereof.

In the instant specification and claims, by the term "lithography" is meant a printing method in which a reverse image is formed on a plate and an ink image on the plate is directly transferred on a material to be printed, and by the term "offset printing" is meant a printing method in which a normal image is formed on a plate and an ink image on the plate is once transferred on a blanket roll and is then transferred on a material to be printed.

(2) Description of the Prior Art

Plates in which an oleophilic ink-supporting portion corresponding to an image to be printed and a hydrophilic ink-repelling portion corresponding to the background are formed on a suitable water-resistant substrate have heretofore been broadly used for lithography or offset printing.

These known plates for lithography or offset printing, however, are insufficient in the combination of the resolving power and image density. For example, plates formed by subjecting an electrophotrographic recording material having a photoconductive layer to charging and imagewise exposure to form an electrostatic latent image on the photoconductive layer, developing this latent image by a toner comprising a carbon black and a resin, fixing the developed image and then subjecting the photoconductive layer to an etching treatment, in which the toner-fixed portion acts as an ink-supporting portion and the background acts as an ink-repelling portion, have been broadly used for lithography or offset printing. These plates, however, have a relatively low ink-retaining property, and therefore, they have a defect that the image density of the resulting prints is ordinarily lower than that of prints obtained by relief printing or intaglio printing. Of course, the image density may be enhanced by increasing the amount of an ink applied to a plate for ligthography or offset printing, but if the amount of an ink is thus increased, the resolving power in prints is lowered because of the flowability of the ink, resulting in such defects as disarray of the image.

SUMMARY OF THE INVENTION

We found that when particles composed of triiron tetroxide or γ-type diiron trioxide are embedded in the surface of a water-resistant coating layer consisting of an inorganic pigment dispersed in a water-insoluble resin binder to form an oleophilic ink-supporting portion, this triiron tetroxide or γ-type diiron trioxide has a high ink-retaining property and prints having a high image density and a high resolving power can be obtained.

It also was found that when particles composed mainly of at least one member selected from triiron tetroxide and γ-type diiron trioxide are applied to a water-resistant coating layer as mentioned above in areas corresponding to an image pattern to be printed and the particle-applied water-resistant coating layer is passed through press rolls, the particles can be tightly embedded in the water-resistant coating layer and the water-resistant coating layer can be smoothened and rendered compact in the background portion other than the particle-embedded areas, whereby surface roughening can be prevented at the etching step and the resistance to the printing operation, namely the durability, can be remarkably improved.

More specifically, in accordance with the fundamental aspect of this invention, there is provided a plate for lithography or offset printing comprising a flexible substrate and a water-resistant coating layer formed on said flexible substrate, said water-resistant coating layer being composed of a water-insoluble resin binder and an inorganic pigment dispersed in said binder, and said water-resistant coating layer including an oleophilic ink-supporting portion composed of particles consisting essentially of at least one member selected from triiron tetroxide and γ-type diiron trioxide, said particles being embedded in at least a part of the surface of said coating layer, and an etched hydrophilic ink-repelling portion composed of said inorganic pigment.

This invention will now be described in detail.

BRIEF DESCRIPTION OF THE DRAWING

FIGS. 2-A to 2-E are views showing the steps of an embodiment of the process for preparing a plate for lithography or offset printing according to this invention, in which FIG. 2-A shows the charging step, FIG. 2-B shows the exposure step, FIG. 2-C shows the developing step, FIG. 2-D shows the fixing step and FIG. 2-E shows the etching step.

DETAILED DESCRIPTION OF THE PREFERRED EMBODIMENTS

Figure 1:
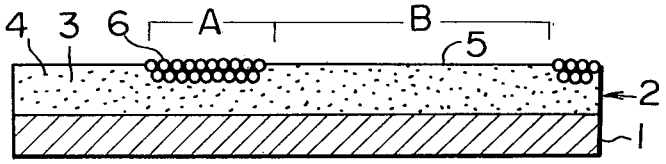
FIG. 1 is a view illustrating diagrammatically the sectional structure of a plate for lithography or offset printing according to this invention.
Figure 1:
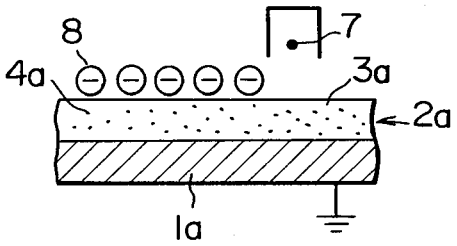
Figure 1:
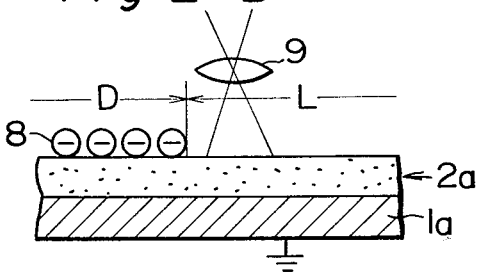
Figure 1:
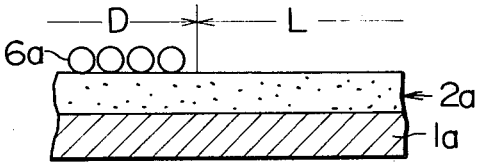
Figure 1:
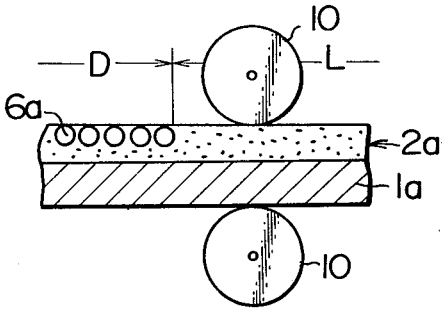
Figure 1:
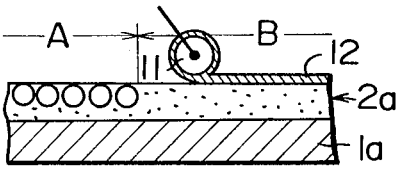

Referring now to FIG. 1 illustrating diagrammatically the section of a plate for lithography or offset printing according to this invention, this plate comprises a flexible substrate 1 and a water-resistant coating layer 2 formed on one surface of the flexible substrate, and this water-resistant coating layer 2 is composed of a water-insoluble resin binder 3 and an inorganic pigment 4 uniformly dispersed in the binder 3. An oleophilic ink-supporting portion A corresponding to an image pattern to be printed and a hydrophilic ink-repelling portion B corresponding to the background are formed on the surface of the water-resistant coating layer 2. In the ink-repelling portion B, the surface 5 of the water-resistant coating layer 2 is etched by known means to render the pigment hydrophilic.

One important feature of this invention is that the above-mentioned oleophilic ink-supporting portion A is composed of particles 6 consisting essentially of triiron tetroxide or γ-type diiron trioxide, which are embedded in the surface of the water-resistant coating layer 2. Since triiron tetroxide or γ-type diiron trioxide has a much higher oil ink-absorbing property than other pigments, use of triiron tetroxide or γ-type diiron trioxide is especially suitable for attaining the objects of this invention. Further, in order to attain the objects of this invention, it is very important that triiron tetroxide or γ-type diiron trioxide particles are embedded in the water-resistant coating layer. In known plates for lithography, when prints having a high image density are formed, an ink is applied in the state protuberant on the oleophilic ink-supporting portion A, and when this protuberant ink is pressed to paper or a blanket roller, the ink is transferred on the paper or blanket roller in an area a little broader than the area of the ink-supporting portion A. Accordingly, in known plates for lithography or offset printing, reduction of the resolving power or disturbance of the image is inevitably caused to occur, and if it is intended to eliminate these defects, the image density must inevitably be lowered.

In contrast, according to this invention, since triiron tetroxide or $\gamma$-type diiron trioxide having a high oil-absorbing property is embedded in the surface of the water-resistant coating layer, a sufficient amount of an oily ink is absorbed and retained in the ink-supporting portion A without excessive protuberance of the ink from the surface, and therefore, prints having a high image density can be obtained without reduction of the resolving power or disarray of the image.

In this invention, as the flexible substrate, there are preferably employed paper substrates such as coated paper, art paper, tissue paper and raw paper for copying paper, synthetic resin films such as a biaxially stretched stretched polyester film, a biaxially polyamide film, a biaxially stretched polypropylene film, a polycarbonate film and a polyvinyl chloride film, metal foils such as an aluminum foil and a copper foil, and laminates of two or more of the foregoing substrates.

As the water-insoluble resin constituting the water-resistant coating layer, there can be mentioned, for example, an acrylic resin, a styrene homopolymer, a styrene copolymer, an olefin resin, a vinyl chloride resin, a vinyl acetate resin, a polyester resin, a polyvinyl acetal resin, an alkyd resin, an epoxy resin, a phenolic resin, a xylene resin, a melamine resin, a silicone resin and a mixture of two or more of the foregoing resins. Use of an acrylic resin and/or an alkyd resin is especially preferred.

As the inorganic filler to be dispersed in the water-insoluble resin, any of inorganic pigments can be used so far as its surface is rendered hydrophilic by a known etching treatment. For example, there can be used oxides, hydroxides, carbonates and sulfates of metals of the groups II, III and IV and composites of these metal compounds, such as zinc oxide, titanium oxide, lead oxide, tin oxide, aluminum oxide, barium oxide, magnesium oxide, magnesium hydroxide, basic magnesium carbonate, barium carbonate, calcium silicate, aluminum silicate, kaolin, montmorillonite, lithopone and barium sulfate. Use of microcrystalline zine oxide is especially preferred in this invention. The particle size of the inorganic pigment is not particularly critical in this invention, but especially good results are obtained when a finely divided inorganic pigment having a particle size of 0.3 to 1.5$\mu$ is used.

Another feature of the plate for lithography or offset printing according to this invention is that the water-resistant coating layer is smoothened and rendered compact. This feature can be attained by selecting an appropriate composition in the water-resistant coating layer and adjusting appropriately the pressure of a press roller when particles consisting essentially of triiron tetroxide and/or $\gamma$-type diiron trioxide are embedded in the coating layer.

In order to attain the above-mentioned smoothening and compaction of the water-resistant coating layer, it is important that the ratio of the amount (A) of the water-insoluble resin binder to the amount (B) of the inorganic pigment is in the range of 1/10 to 4/10, especially from 2/10 to 2.5/10. When the amount (B) of the inorganic pigment is smaller than the amount included in the above range, as will be apparent from Examples given hereinafter, it is difficult to attain sufficient compactness and smoothness, and hence, contamination of the background or reduction of the resistance to the printing operation is caused by the surface roughening. When the amount (B) of the inorganic pigment is larger than the amount included in the above range, even if the etching treatment is carried out under severe conditions, it is difficult to render the background-constituting ink-repelling portion sufficiently hydrophilic.

The water-resistant coating layer having the above-mentioned composition is passed through between a pair of press rollers to effect smoothening and compaction. Ideally, a linear contact is attained between the press rollers and the water-resistant coating layer. Accordingly, in this invention, a very high pressure can be applied to the water-resistant coating layer and such high smoothening and compacting effects as not expected in the conventional plates can be attained. It is preferred that the linear pressure applied to the press rollers be at least 15 Kg per cm of the roller length, especially at least 30 Kg per cm of the roller length.

Either before or after the etching treatment, the water-resistant coating layer of the printing plate according to this invention has a smoothness not higher than 60 mm Hg (absolute), especially not higher than 30 mm Hg (absolute), as measured by a vacuum micrometer type smoothness tester, and the compactness (R) defined by the following formula:

$$R = \frac{W_0 - W_1}{W_0} \times 100$$

wherein $W_0$ stands for the water-absorbing capacity (g/m$^2$) of the water-resistant layer at 20° C. before it is passed through between the press rollers and $W_1$ represents the water-absorbing capacity (g/m$^2$) of the water-resistant layer at 20° C. after it has been passed through the press rollers, is at least 10%, especially at least 20% after the etching treatment.

The thickness of the water-resistant layer is determined so that particles of the above-mentioned iron oxide can be sufficiently embedded and a sufficient resistance to the printing operation can be obtained. In order to attain such thickness, in general, it is preferred that the coated amount of the water-resistant coating be at least 3 g/m$^2$, especially in the range of 10 to 30 g/m$^2$.

In order to absorb sufficiently an oily ink and retain it in the water-resistant coating layer and obtain prints having high image density and resolving power, it is preferred that particles consisting essentially of triiron tetroxide and/or diiron trioxide, which are embedded in the water-resistant coating layer, have an oil absorption of at least 15, especially at least 25, and that the ink-supporting portion composed of such particles be formed in the water-resistant coating layer in an average thickness of 10 to 60$\mu$, especially 20 to 30$\mu$. If the oil absorption of the particles is lower than 15, as will be apparent from Examples given hereinafter, the resulting plate is inferior with respect to the combination of the image density and resolving power.

The above-mentioned oil absorption and embedded thickness of the particles can preferably be attained by appropriately selecting the composition, particle size and structure of the particles.

According to a preferred embodiment of this invention, the particles which are embedded in the water-resistant coating layer comprise 100 parts by weight of triiron tetroxide and/or γ-type diiron trioxide, 10 to 150 parts by weight, especially 25 to 100 parts by weight, of a binder and up to 30 parts by weight, especially 1 to 20 parts by weight, of carbon black. When the binder is contained in an amount larger than the amount included in the above range, it is difficult to obtain particles having an oil absorption of at least 20, and when the amount of the binder is smaller than the amount included in the above range, it is difficult to form the ink-supporting portion in the above-mentioned thickness and the durability of the ink-supporting portion is reduced. Carbon black has effects of improving the oil-absorbing property of the particles and improving the flow characteristics of the particles to facilitate embedding of the particles when it is incorporated in the above-mentioned amount. As the binder, there may be used waxes, resins, rubbers and mixtures thereof. In order to attain the objects of this invention, it is preferred that a mixture comprising 5 to 45% by weight of a wax and 55 to 95% by weight of a resin be used as the binder.

In this invention, the particle size of the particles which are embedded in the water-resistant coating layer is not particularly critical, but in general, in order to attain the objects of this invention, it is preferred that the particle size be in the range of from 5 to 50μ, especially from 10 to 44μ.

The intended objects of this invention can be advantageously attained when the particles that are embedded in the water-resistant coating layer consisting of nuclear particles composed of triiron tetroxide and/or γ-type diiron trioxide, a binder such as mentioned above and if desired, a part of carbon black, and all or the remainder of carbon black crumbed on the nuclear particles.

The plate for lithography or offset printing according to this invention can easily be prepared by utilizing the ferromagnetic characteristic of triiron tetroxide and/or γ-type diiron trioxide. More specifically, the printing plate of this invention can easily be prepared by using the above-mentioned particles as a developing toner in the electrophotographic process and fixing the toner according to the fixing method using a press roller. This is another prominent advantage attained by this invention.

In accordance with another aspect of this invention, there is provided a process for the preparation of plates for lithography or offset printing which comprises the steps of charging a photoconductive layer composed of a highly electrically insulating, water-insoluble resin binder and a photoconductive inorganic pigment dispersed in the binder, exposing the photoconductive layer imagewise to actinic rays to form an electrostatic latent image on the photoconductive layer, developing the electrostatic latent image formed on the photoconductive layer with a developer composed mainly of at least one member selected from triiron tetroxide and γ-type diiron trioxide, passing the photoconductive layer having a visible image of the developer through between press rollers to embed particles of the developer in the surface of the photoconductive layer and form an oleophilic ink-supporting portion corresponding to a pattern to be printed, and treating the photoconductive layer with an etching solution.

This process for the preparation of plates for lithography or offset printing will now be described by reference to FIGS. 2-A to 2-E.

A photoconductive layer 2a consisting of a highly electrically insulating resin binder 3a and a photoconductive inorganic pigment 4a dispersed in the binder 3a is formed on a flexible substrate 1a. Referring to FIG. 2-A illustrating the charging step, the photoconductive layer 2a is charged with an electricity 8 of a certain polarity by a known charging mechanism such as a corona discharge mechanism 7.

Referring to FIG. 2-B showing the exposure step, the charged photoconductive layer 2a is exposed imagewise through an optical system 9. In the non-exposed areas D, the photoconductive layer 2a still retains the highly electrically insulating property and the electricity 8 is left. On the other hand, in the exposed areas L, the photoconductive layer 2a is rendered electrically conductive and the electricity is dissipated, whereby an electrostatic latent image corresponding to an image pattern to be printed is formed on the photoconductive layer 2a.

Referring now to FIG. 2-C showing the developing step, the photoconductive layer 2a on which the electrostatic image has been formed is developed with a developer 6a composed mainly of triiron tetroxide and/or γ-type diiron trioxide to visualize the electrostatic latent image. Since triiron tetroxide and γ-type diiron trioxide are highly ferromagnetic, a known magnetic brush developing method can be advantageously adopted by using this developer as a so-called one-component type magnetic developer.

Referring to FIG. 2-D showing the fixing step, the image-visualized photoconductive layer 2a is fed to between a pair of press rollers 10 to embed particles composed mainly of triiron tetroxide and/or diiron trioxide into the surface portion of the photoconductive layer 2a and effect smoothening and compaction of the surface of the photoconductive layer 2a.

Referring to FIG. 2-E showing the etching step, an etching solution 12 is applied to the surface of the photoconductive layer 2a by a coating mechanism 11 such as a roller to form an image pattern to be printed, namely an oleophilic ink-supporting portion A corresponding to the non-exposed areas D and a background constituting hydrophilic ink-repelling portion B corresponding to the exposed areas D, on the surface of the photoconductive layer 2a.

As the coating composition for formation of the photoconductive layer, there may be employed, for example, a composition comprising 100 parts by weight of a photoconductive pigment, 20 to 25 parts by weight of an electrically insulating resin, 0.01 to 0.3 part by weight of a photosensitizer, up to 0.005 part by weight of a memory resistance improver and up to 0.5 part by weight of a moisture resistance improver in the form of a solution in an aromatic solvent such as toluene, xylene or the like. Inorganic pigments having a photo-conductivity are chosen among the above-mentioned inorganic pigments and used as the photoconductive inorganic solvent. Use of zinc oxide is especially preferred. Water-insoluble resins having a volume resistivity of at least $1\times10^{14}$ Ω-cm are chosen among the above-mentioned water-insoluble resins, for example, acrylic resins, and they are used as the electrically insulating resin. Photosensitizing dyes such as Rose Bengale, Bromophenol Blue and Erythorosine are used as the photosensitizer. An oxidant such as sodium dichromate is used as the memory resistance improver and a metal salt of an organic acid such as cobalt naphthenate is used as the moisture resistance improver.

As the flexible electrically conductive substrate, there can be used a product formed by coating an electrically conductive resinous composition to the surface of a paper substrate such as mentioned above so that the volume resistivity is lower than $1\times10^{10}$ Ω-cm. As the electrically conductive resinous composition, there may be employed a composition comprising a cationic, anionic or non-ionic resinous electrically conductive agent and, if desired, an additive such as a water-soluble inorganic salt, an organic moisture-absorbing low-molecular-weight compound or the like.

In general, it is preferred to apply on one surface of a paper substrate a backcoat-forming composition comprising a cationic resinous electrically conductive agent, a water-soluble inorganic salt, an organic moisture-absorbing low-molecular-weight compound, a water-soluble or water-dispersible resin and a binder in an amount coated of 3 to 20 g/m$^2$, apply to the other surface of the paper substrate an undercoat-forming composition comprising a cationic resinous electrically conductive agent, a water-soluble or water-dispersible resin and a binder in an amount coated of 3 to 20 g/m$^2$ and form a photoconductive layer on the paper substrate through this undercoat layer.

As the developer composed mainly of triiron tetroxide and/or γ-type diiron trioxide, there are preferably employed fine particles having the above-mentioned composition. As the binder, there can be used, for example, mineral, animal, vegetable and synthetic waxes such as paraffin wax, fatty acid amides, fatty acids, carnauba wax, montan wax, hydrogenated beef tallow, bees wax, sperm wax and cotton wax, and resins such as ethylene-vinyl acetate copolymers, hydrogenated styrene resins, epoxy resins, xylene resins, polyamide resins, polyester resins and urethane resins. As the carbon black, there can be employed furnace black, channel black and lamp black. In general, it is preferred that the particle size of this developer be in the range of 5 to 40μ.

Any of etching solutions customarily used for preparation of plates for lithography can be used. For example, an aqueous solution containing 10 to 20% of at least one member selected from water-soluble ferroxyanates, ferricyanates, phosphates and polybasic organic carboxylic acid salts. The etching solution may be coated according to any of known methods such as a dip coating method, a roller coating method, a brush coating method and a spray coating method.

In accordance with still another aspect of this invention, there is provided a process for the preparation of plates for lithography and offset printing which comprises the steps of charging an electrostatic photosensitive layer and exposing it imagewise to actinic rays to form an electrostatic latent image on the photosensitive layer, transferring said electrostatic latent image on a water-resistant coating layer composed of a water-insoluble resin binder and an inorganic pigment dispersed in said binder and formed on a flexible substrate, developing the electrostatic latent image transferred on the water-resistant coating layer with a developer composed mainly of at least one member selected from triiron tetroxide and γ-type diiron trioxide to visualize the electrostatic latent image, passing the water-resistant coating layer having a visible image of the developer thereon through between a pair of press rollers to embed developer particles in the surface of the water-resistant coating layer and form an oleophilic ink-supporting portion corresponding to a pattern to be printed, and treating the water-resistant coating layer with an etching solution to form a hydrophilic ink-repelling portion corresponding to the background. According to this embodiment, there is attained an advantage that an inorganic pigment having no electric conductivity can be used as the inorganic pigment to be dispersed in the water-resistant coating layer. It is preferred that the volume resistivity of the water-resistant coating layer be at least $1\times10^{12}$ Ω-cm.

In accordance with still another aspect of this invention, there is provided a process for the preparation of plates for lithography or offset printing which comprises the steps of charging an electrostatic photosensitive layer and exposing it imagewise to actinic rays to form an electrostatic latent image on the photosensitive layer, developing the electrostatic latent image with a developer composed mainly of at least one member selected from triiron tetroxide and γ-type diiron trioxide, transferring an image of the developer on a water-resistant coating layer composed of a water-insoluble resin binder and an inorganic pigment dispersed in the binder and formed on a flexible substrate, passing the water-resistant coating layer having the developer image transferred thereon through between a pair of press rollers to embed particles of the developer in the surface of the water-resistant coating layer and form an oleophilic ink-supporting portion corresponding to a pattern to be printed, and treating the water-resistant coating layer with an etching solution to form a hydrophilic ink-repelling portion corresponding to the background. According to this embodiment, there is attained an advantage that the kinds of the inorganic pigment and water-insoluble resin are not particularly limited.

The plate of this invention can be advantageously used for lithography or offset printing and prints having high image density and resolving power can be prepared by using the plate of this invention. Moreover, plates prepared according to the above-mentioned processes of this invention have a merit that the resistance to the printing operation is very excellent.

This invention will now be described in detail by reference to the following Examples, in which all of "parts" and "%" are by weight.

Comparative master samples were prepared and the offset printing was carried out by using so prepared in master samples. The printing machine used was an offset printing machine Model AM 240 manufactured by Addressograph Multigraph Co. (equipped with an automatic etching device). The master samples used are summarized in Table 1 and results of the printing operation are shown in Table 2. Properties shown in Table 2 were determined according to the following methods.

(A) Print Density:

The print density was measured by using a reflection densitometer Model PDM-5 manufactured by Konishiroku Shashin Kogyo Kabushiki Kaisha, and was evaluated according to the following scale:

○ : density higher than 1.0
Δ: density of 0.5 to 1.0
X: density lower than 0.5

(B) Print Quality:

The print quality was determined based on the disarray of the image or bleeding of the ink at the printing operation at a high concentration (large amount of the ink supplied) according to the following scale:

○ : no disarray or not bleeding

Δ: slight disarray and slight bleeding

X: conspicuous disarray and conspicuous bleeding (C) Reduction of Oil Insensitivity in Ink-Repelling Portion:

The surface condition of the print was examined after 500 prints had been obtained by using the above-mentioned printing machine Model AM-240 equipped with an automatic etching device, and the reduction of the oil insensitivity in the ink-repelling portion was evaluated according to the following scale:

○ : no fogging on the surface

Δ: slight fogging on the surface

X: conspicuous fogging on the surface (D) Uniformity of Printing:

The uniformity of printing was evaluated based on the degree of dyeing uniformity in a solid black portion (5 cm×5 cm) according to the following scale:

○ : very uniform

Δ: slightly non-uniform

X: conspicuously non-uniform

TABLE 1

| Sample | Copying Machine Used For Preparation of Master | Developing Method | Fixing Method | Main Components of Developer |
|---|---|---|---|---|
| Comparative Sample No. 1 | Copystar 280 manufactured by Mita Industrial Co. | wet method | cold air | carbon black plus resin |
| Comparative Sample No. 2 | Copystar 251 manufactured by Mita Industrial Co. | dry method (plain paper copying) | oven heater** | carbon black plus resin |
| Comparative Sample No. 3 | Copystar 251 manufactured by Mita Industrial Co. | dry method (plain paper copying) | press roller** | carbon black plus resin |
| Comparative Sample No. 4 | Copystar 700D manufactured by Mita Industrial Co. | dry method (plain paper copying) | heating roller | triiron tetroxide plus resin |
| Sample of This Invention | Copystar 900D | dry method (plain paper copying) | press roller | triiron tetroxide plus resin |

Notes

Offset master papers manufactured by Mita Industrial Co. were used for production of the above master samples.

*: An oven heater (infrared heater) manufactured by Mita Industrial Co. was used only for fixation.

**: A press roll (linear pressure = 30 Kg/cm) manufactured by Mita Industrial Co. was used.

TABLE 2

| Sample | Print Density | Print Quality | Reduction of Oil Insensitivity | Printing Uniformity |
|---|---|---|---|---|
| Comparative Sample No. 1 | X | ○ | Δ | X |
| Comparative Sample No. 2 | Δ | Δ | Δ | Δ |
| Comparative Sample No. 3 | Δ | ○ | ○ | Δ |
| Comparative Sample No. 4 | Δ | Δ | Δ | Δ |
| Sample of This Invention | ○ | ○ | ○ | ○ |

EXAMPLE 1

A dispersion having the following Composition 1-1 was coated on a high quality paper having a basis weight of 89 g/m$^2$ and dried at 100° C. for 1 minute to form an intermediate layer having a coated amount of 10 g/m$^2$.

| Composition 1-1 | |
|---|---|
| Vinyl acetate type aqueous emulsion | 300 parts |

-continued

| Composition 1-1 | |
|---|---|
| resin (Polysol 2NS manufactured by Showa Kobunshi Kabushiki Kaisha; solid content = 50%) | |
| Electrically conductive resin (ECR-34 manufactured by Dow Chemical Co.; solid content = 33.5%) | 150 parts |
| Water | 250 parts |

A dispersion having the following Composition 1-2 was coated on the surface of the high quality paper opposite to the surface on which the intermediate layer had been coated and dried at 100° C. for 1 minute to obtain a backcoat layer having an amount coated of 12 g/m$^2$.

| Composition 1-2 | |
|---|---|
| Same vinyl acetate type aqueous emulsion as used in Composition 1-1 | 70 parts |
| Aqueous dispersion of clay (kaolin clay; solid content = 50%) | 100 parts |
| Electrically conductive resin (same as used in Composition 1-1) | 60 parts |
| Water | 200 parts |

The coated paper was processed by a super calender to obtain an electrically conductive support.

A dispersion for formation of a photoconductive layer having the following Composition 1-3 was coated on the intermediate layer of this support and dried at 120° C. for 2 minutes to obtain an electrophotographic copying paper including a photosensitive layer having an amount coated of 17 g/m$^2$.

| Composition 1-3 | |
|---|---|
| Zinc oxide (SOX 500 manufactured by Seido Kagaku Kogyo Kabushiki Kaisha) | 180 parts |
| Acrylic resin (FR-83 manufactured by Mitsubishi Rayon Kabushiki Kaisha; solid content = 40%) | 75 parts |
| Acrylic resin (LR-188 manufactured by Mitsubishi Rayon Kabushiki Kaisha, solid content = 40% | 40 parts |
| Rose Bengale (1% solution in methanol) | 72 parts |
| Toluene | 260 parts |

The so prepared photosensitive paper was developed with a one-component magnetic toner having the following Composition 1-4 and the toner image was fixed by using an electric copying machine of the pressure fixation type (Copystar 900D manufactured by Mita Industrial Co.) The fixation pressure (linear pressure) was 30 Kg/cm

| Composition 1-4 | |
|---|---|
| Hydrogenated styrene resin (Arkon P-125 manufactured by Arakawa Rinsan Kagaku Kogyo Kabushiki) | 45 parts |
| Nigrosine Sterate (salt composed of 1 part of Nigrosine Base and 4 parts of stearic acid) | 10 parts |
| Fatty acid amide (Amide AP-1 manufactured by Nippon Kasei Kabushiki Kaisha; melting point higher than 98° C.) | 25 parts |
| Ethylene-vinyl acetate copolymer resin (Evaflex 420 manufactured by Mitsui Polychemical Kabushiki Kaisha) | 20 parts |

The above composition was dissolved under agitation in 1000 parts of heated toluene. Then, 250 parts of triiron tetroxide (Tetsuguro B6 manufactured by Toyo Shikiso Kabushiki Kaisha) and 12 parts of carbon black (Corax L manufactured by Degussa Inc.) were added to the solution and dispersed therein for 30 minutes by using a homogenizing mixer to obtain a dispersion for spray drying. While the dispersion was maintained at 70° C., the dispersion was sprayed in hot air maintained at 150° C. to obtain spherical dry fine particles. The particles were classified to collect particles having a particle size of 5 to 30$\mu$. Then, 0.08 part of carbon black (above-mentioned Corax L) was added to the particles and the blend was homogeneous mixer by means of a V-type mixer to obtain a toner.

Then, the developed and fixed photosensitive paper was treated with an etching solution having the following Composition 1-5 to form an ink-repelling portion and it was then set to an offset printing machine, Model 1010 manufactured by Ricoh Kabushiki Kaisha to perform the offset printing. Prints having a high image density and a high resolving power were obtained.

| Composition 1-5 | |
|---|---|
| Potassium ferrocyanate | 5 parts |
| Sodium phosphate | 5 parts |
| Sodium hydrogenphosphate | 5 parts |
| Water | 85 parts |

The pH was adjusted to 5 by addition of citric acid.

EXAMPLE 2

A dispersion having the following Composition 2-1 was coated on wet strength paper having a basis weight of 95 g/m$^2$ and dried at 80° C. for 2 minutes to form an intermediate layer.

| Composition 2-1 | |
|---|---|
| Acrylic-vinyl acetate copolymer aqueous emulsion resin (Sebian A-522 manufactured by Daicel Kabushiki Kaisha; solid content = 46.5%) | 300 parts |
| Electrically conductive resin (ET-68 manufactured by Dainippon Shikizai Kabushiki Kaisha; solid content = 33%) | 140 parts |

-continued

| Composition 2-1 | |
|---|---|
| Water | 240 parts |

A dispersion having the following Composition 2-2 was coated on the surface opposite to the surface on which the intermediate layer had been formed, and dried at 80° C. for 2 minutes to form a backcoat layer having an amount coated of 15 g/m$^2$.

| Composition 2-2 | |
|---|---|
| Same vinyl acetate type aqueous emulsion resin as used in Composition 1-1 of Example 1 | 80 parts |
| Aqueous dispersion of clay (same as used in Composition 1-2 of Example 1) | 100 parts |
| Electrically conductive resin (Color Fax ECA manufactured by Imperial Chemical Co.; solid content = 33.3%) | 70 parts |
| Water | 200 parts |

The coated paper was processed by a super calender to impart smoothness to the paper. Thus, an electrically conductive support was formed.

A dispersion for formation of a photoconductive layer having the following Composition 2-3 was coated on the intermediate layer and dried at 120° C. for 2 minutes to obtain a photosensitive paper for offset printing. The amount coated of the photosensitive layer was 20 g/m$^2$.

| Composition 2-3 | |
|---|---|
| Zinc oxide (Sazex No. 4000 manufactured by Sakai Kagaku Kogyo Kabushiki Kaisha) | 100 parts |
| Acrylic resin (Acrylic 6-1036 manufactured by Dainippon Ink Kagaku Kogyo Kabushiki Kaisha; solid content = 50%) | 40 parts |
| Sodium dichromate dihydrate (0.2% solution in methanol) | 4 parts |
| Bromophenol Blue (0.2% solution in methanol) | 6 parts |
| Toluene | 100 parts |

The so obtained photosensitive paper was developed with a one-component type of the following Composition 2-4 and the toner image was fixed by using the same copying machine as used in Example 1 to form an image. The fixing pressure (linear pressure) was 30 Kg/cm.

| Composition 2-4 | |
|---|---|
| Hydrogenated styrene resin (same as used in Composition 1-4 of Example 1) | 60 parts |
| Fatty acid amide (Diamide 0-200 manufactured by Nippon Kasei Kabushiki Kaisha; melting point higher than 71° C.) | 20 parts |
| Ethylene-vinyl acetate copolymer (Evaflex 410 manufactured by Mitsui Polychemical Kabushiki Kaisha) | 20 parts |

The above composition was dissolved under agitation in 800 parts of heated toluene and 260 parts of the same triiron tetroxide as used in Composition 1-4 of Example 1 and 12 parts of the same carbon black as used in Composition 1-4 of Example 1 were added to the solution.

The blend was mixed and dispersed by a homogenizing mixer to obtain a dispersion for spray drying. While the dispersion was maintained at 70° C., it was sprayed in hot air maintained at 150° C. to obtain spherical dry particles. The particles were classified to collect particles having a size of 5 to 30μ, and 0.08 part of the same carbon black as described above was added to the particles and the blend was homogeneously mixed by a V-type mixer to obtain a toner.

The developed and fixed photosensitive paper was treated with an etching solution having the following Composition 2-5 to form an ink-repelling portion. The resulting offset master was set to the same offset printing machine as used in Example 1 and the offset printing operation was conducted. More than 2000 prints having a high density and a high resolving power were obtained.

| Composition 2-5 | |
|---|---|
| Potassium ferrocyanate | 5 parts |
| Sodium monohydrogenphosphate | 5 parts |
| Sodium phosphate | 5 parts |
| Water | 85 parts |

The pH was adjusted to 5 by addition of citric acid.

EXAMPLE 3

A photoconductive coating solution having the following Composition 3-1 was coated in a dry amount coated of 25 g/m$^2$ on a support for offset printing, which had been prepared in the same manner as described in Example 1, to obtain a photosensitive plate for plain paper copying.

| Composition 3-1 | |
|---|---|
| Zinc oxide (same as used in Composition 2-3 of Example 2) | 100 parts |
| Toluene | 130 parts |
| Rose Bengale (1% solution in methanol) | 10 parts |
| Bromophenol Blue (1% solution in methanol) | 4 parts |
| Acrylic resin (same as used in Composition 2-3 of Example 2) | 10 parts |
| Acrylic resin (Acrydic 6-1028 manufactured by Dainippon Ink Kabushiki Kaisha; solid content = 50%) | 5 parts |
| Acrylic resin (LR-018 manufactured by Mitsubishi Rayon Kabushiki Kaisha; solid content = 40%) | 19 parts |
| Acrylic resin (Arotap 3211 manufactured by Nippon Shokubai Kagaku Kogyo Kabushiki Kaisha) | 10 parts |

The resulting photosensitive plate for plain paper copying was developed with a one-component type magnetic toner of the pressure fixation type having the following Composition 3-2 and a particle size of 5 to 13μ by using an electrophotographic copying machine (Copystar 350D manufactured by Mita Industrial Co.) (the fixing zone had been removed from the copying machine prior to the development).

| Composition 3-2 | |
|---|---|
| Hydrogenated styrene resin (Arcon P-115 manufactured by Arakawa Rinsan Kagaku Kogyo Kabushiki Kaisha) | 60 parts |

-continued

| Composition 3-2 | |
|---|---|
| Palmitic acid N—dodecylamide | 15 parts |
| Ethylene-vinyl acetate copolymer (Evaflex 310 manufactured by Mitsui Polychemical Kabushiki Kaisha) | 25 parts |

The above composition was dissolved under heating in 900 parts of heated toluene and 260 parts of the same triiron tetroxide as used in Composition 1-4 of Example 1 and 10 parts of the same carbon black as used in Composition 1-4 of Example 1 were added to the solution. The mixture was dispersed for 30 minutes by using a homogenizing mixer to obtain a dispersion for spray drying. A toner was obtained in the same manner as described in Example 1.

The developed toner image was transferred on transfer papers described in the following Compositions 3-3 to 3-9, and the transfer papers were passed through chromium-plated metal rollers under a linear pressure of 30 Kg/cm and subjected to the etching treatment by using an automatic etching apparatus (Master Convertor 124 manufactured by Addressograph Multigraph Co.) and to the offset printing by using the same offset printing machine as described in Example 1. In each case, prints having a high density and a high resolving power are obtained.

The above photosensitive plate for plain paper copying could be used repeatedly.

| | |
|---|---|
| Composition 3-3 | |
| Titanium oxide | 100 parts |
| Styrenated alkyd resin (Rastorasol 4400 manufactured by Dainippon Ink Kagaku Kogyo Kabushiki Kaisha; solid content = 50%) | 20 parts |
| Toluene | 100 parts |
| Composition 3-4 | |
| Kaolinite | 100 parts |
| Vinyl acetate resin | 15 parts |
| Methyl alcohol | 85 parts |
| Composition 3-5 | |
| Aluminum oxide | 100 parts |
| Alkyd resin | 25 parts |
| Toluene | 100 parts |
| Composition 3-6 | |
| Zinc oxide | 100 parts |
| Styrene-butadiene copolymer | 40 parts |
| Toluene | 100 parts |
| Composition 3-7 | |
| Silica | 50 parts |
| Polyester | 50 parts |
| Toluene | 80 parts |
| Composition 3-8 | |
| Lead oxide | 100 parts |
| Epoxy resin | 30 parts |
| Acetone | 80 parts |
| Composition 3-9 | |
| Zinc oxide | 100 parts |
| Silicone resin | 20 parts |
| Acrylic resin | 20 parts |
| Toluene | 100 parts |

The foregoing compositions were applied in amounts coated of 5 to 15 g/m$^2$ on art paper, coated paper and high quality paper which had been subjected to the water-proofing treatment and had a basis weight of about 100 g/m$^2$, aluminum foils and synthetic papers having a thickness of 30 to 40μ to prepare transfer papers.

EXAMPLE 4

A photosensitive solution having the following Composition 4-1 was coated in an amount coated of 10 g/m$^2$ on an electrically conductive support formed by vacuum-depositing aluminum on a polyethylene terephthalate film and the applied coating was then dried.

| Composition 4-1 | |
|---|---|
| Poly-N—vinylcarbazole | 15 parts |
| 2,5,7-Trinitrofluorenone | 5 parts |
| Dichloromethane | 170 parts |

The so obtained photosensitive plate was positively corona-discharged in the dark place to charge the plate so that the surface potential was about 350 V. An original was superposed on the charged photosensitive plate and the assembly was exposed to actinic rays to form an electrostatic latent image, and the latent image was developed with a one-component type toner of the pressure fixation type having the following Composition 4-2.

| Composition 4-2 | |
|---|---|
| Hydrogenated styrene resin (same as used in Composition 1-4 in Example 1) | 50 parts |
| Epoxy resin (Epichlon 4050 manufactured by Esso Standard Sekiyu Kabushiki Kaisha) | 10 parts |
| Fatty acid amide (same as used in Composition 2-4 of Example 2) | 20 parts |
| Ethylene-vinyl acetate copolymer (same as used in Composition 2-4 of Example 2) | 20 parts |

The above composition was dissolved in 800 parts of heated toluene under agitation, and 240 parts of $\gamma$-type diiron trioxide and 15 parts of carbon black were added to the solution and dispersed for 30 minutes in the solution by using a homogenizing mixer to obtain a dispersion for spray drying. While the dispersion was maintained at 70° C., it was sprayed into hot air heated at 150° C. to obtain spherical dry fine particles. Then, 0.08 part of carbon black was added to the particles and the blend was homogeneously mixed by a V-type mixer. Particles having a size of 5 to 15$\mu$ were collected by classification to obtain a toner.

A visible image developed by the above toner was transferred on a transfer paper described in the following Composition 4-3, and fixation of the toner image was conducted by using metallic press rollers under a linear pressure of 30 Kg/cm.

| Composition 4-3 | |
|---|---|
| Vinyl acetate resin (solid content = 50%) | 100 parts |
| Silica (Syloid 244 manufactured by Fuji-Davison Kagaku Kabushiki Kaisha) | 50 parts |
| Toluene | 200 parts |

The above composition was coated in an amount coated of 20 g/m$^2$ on a coated paper having a basis weight of 70 g/m$^2$, which had been subjected to the water-proofing treatment.

The so obtained offset printing master was subjected to the etching treatment by using the same etching apparatus as used in Example 3 and the offset printing was carried out by using an offset printing machine, Model AM-220 manufactured by Addressograph Multigraph Co. to obtain prints having a high density and a high resolving power.

The above master had such a high durability (resistance to the printing operation) that even after 2000 prints had been obtained, contamination of the background or formation of thin spots on the printed image was not observed. Good results were similarly obtained by using the following Composition 4-4 instead of the above Composition 4-3.

| Composition 4-4 | |
|---|---|
| Vinyl chloride-vinyl acetate copolymer | 100 parts |
| Powdery silica gel (Aerosil manufactured by Degussa Inc.) | 20 parts |
| Trichlene | 100 parts |
| Toluene | 50 parts |

The above components were mixed and dispersed sufficiently in a ball mill, and the resulting dispersion was coated in a dry amount coated of 15 g/m$^2$ on high quality paper and dried.

EXAMPLE 5

The following Composition 5-1 was coated in an amount coated of 15 g/m$^2$ on a hard aluminum sheet having a thickness of 30$\mu$ by using a wire bar and dried at 120° C. for 2 minutes to form a photosensitive plate for electrophotography.

| Composition 5-1 | | |
|---|---|---|
| Zinc oxide (same as used in Composition 2-3 in Example 2) | | 50 parts |
| Toluene | | 50 parts |
| Rose Bengale | (dissolved in 1 part of methanol) | 0.0075 part |
| Bromophenol Blue | (dissolved in 1 part of methanol) | 0.0025 part |
| Acrylic resin (same as used in Composition 2-3 in Example 2) | | 1 part |
| Acrylic resin (CR-018 manufactured by Mitsubishi Rayon Kabushiki Kaisha; solid content = 40%) | | 1 part |
| Styrenated alkyd resin (same as used in Composition 3-3 in Example 3) | | 0.25 part |

The so obtained photosensitive plate was negatively corona-discharged in the dark place to charge it so that the surface potential was 570 V.

An original was superposed on the charged photosensitive plate, and the assembly was exposed to actinic rays to form an electrostatic latent image. Then, the exposed photosensitive plate was superposed on an electrostatic transfer sheet described in the following Composition 5-2 and a potential of about 100 V was transferred.

COMPOSITION 5-2

A 20% solution of a water-insoluble electrically conductive resin (E-27S manufactured by Toyo Ink Kabushiki Kaisha) in methyl alcohol was coated in an amount of 3 g/m$^2$ on high quality paper prepared from needle-leaf tree pulp by using a bar coater, and then, a 30% solution of a mixture of 10 parts of polyvinyl butyral and 50 parts of clay in methanol was coated in an amount coated of 10 g/m$^2$ on the above base paper.

Development was carried out by using the same one-component type magnetic toner of Composition 4-2 as used in Example 4 and fixation was carried out by using chromium-plated metallic rolls under a linear pressure of 30 Kg/cm. The resulting master was etched by using the same etching machine as used in Example 3 and the printing was carried out by using the above etched master and the same offset printing machine as used in Example 1. Prints having a high density and a high resolving power were obtained.

EXAMPLE 6

A dispersion of the following Composition 6-1 was coated in an amount coated of 5 g/m$^2$ on coated paper (Coat Paper SK manufactured by Sanyo Kokusaku Pulp Kabushiki Kaisha) by using a wire bar coater to form an intermediate layer. A dispersion of the Composition 6-2 was coated in an amount coated of 7 g/m$^2$ on the surface opposite to the intermediate layer-formed surface to obtain an electrically conductive support.

| | |
|---|---|
| Composition 6-1 | |
| Polyvinyl butyral resin (Slex W manufactured by Sekisui Kagaku Kogyo Kabushiki Kaisha; solid content = 25%) | 100 parts |
| Silica (same as used in Composition 4-3 in Example 4) | 10 parts |
| Electrically conductive resin (PQ-10 manufactured by Soken Kagaku Kogyo Kabushiki Kaisha; solid content = 50%) | 20 parts |
| Composition 6-2 | |
| Vinyl acetate resin (Vinyrol S manufactured by Showa Kobunshi Kabushiki Kaisha; solid content = 50%) | 100 parts |
| Silica (same as used in Composition 6-2 above) | 15 parts |
| Electrically conductive resin (same as used in Composition 6-1 above) | 30 parts |
| Methanol | 100 parts |

A dispersion for formation of a photoconductive layer having the following Composition 6-3 was coated on the intermediate layer and dried at 120° C. for 2 minutes to obtain an electrophotographic sensitive paper for offset printing having an amount coated of 15 g/m$^2$.

| Composition 6-3 | |
|---|---|
| Zinc oxide (same as used in Composition 2-3 in Example 2) | 240 parts |
| Toluene | 320 parts |
| Rose Bengale (1% solution in methanol) | 10 parts |
| Bromophenol Blue (1% solution in methanol) | 1 part |
| Acrylic resin (same as used in Composition 3-1 of Example 3) | 100 parts |
| Acrylic resin (same as used in Composition 1-3 of Example 1) | 50 parts |

The photosensitive paper was developed with a one-component type magnetic toner of the following Composition 6-4 by using an electrophotographic copying machine of the pressure fixation type (Copystar 1000D manufactured by Mita Industrial Co.) to form a master.

| Composition 6-4 | |
|---|---|
| Triiron tetroxide (same as used in Composition 1-4 of Example 1) | 1 part |
| Epoxy resin (Epichlon 4050 manufactured by Dainippon Ink Kagaku Kogyo Kabushiki Kaisha) | 1 part |
| Acetone | 4 parts |
| Ethyl acetate | 4 parts |

An iron oxide-dispersed resin solution having the above composition was gradually added to 400 parts of water being rotated at 2000 rpm by a high speed agitator. The precipitated solid was recovered by filtration, washed with water and dried at 40° C. to obtain spherical toner particles having an average particle size of 15μ. By using the same copying machine of the pressure fixation type as used in Example 1, the photosensitive paper prepared from the above Compositions 6-1, 6-2 and 6-3 was developed with the so prepared toner and the toner image was fixed. A clear image having a strong fixing power was obtained. The etching treatment was carried out in the same manner as described in Example 5 and the offset printing was carried out. Prints having a uniform image having a high density and a high resolving power were obtained.

The offset printing master obtained in this Example had such a durability that even after more than prints 2000 prints had been obtained high density and high resolving power were maintained in the printed image.

EXAMPLE 7

Good results similar to results obtained in Example 6 were obtained when the photosensitive plate described in Example 6 was used and development was carried out by using a toner prepared in the following manner.

An iron oxide-dispersed resin solution comprising part of a polyamide resin (Versamid 930 manufactured by Daiichi General Kabushiki Kaisha), 5 parts of tetrahydrofuran, 4 parts of n-butanol and 1 part of triiron tetroxide (manufactured by Toda Kogyo Kabushiki Kaisha) was gradually added to 400 parts of water being agitated at 2000 rpm by using a high speed agitator. The precipitated solid was recovered by filtration, washed with water and dried at 40° C. to obtain spherical toner particles having an average particle size of 20μ.

What we claim is:

1. A plate for lithography or offset printing comprising a flexible substrate and a water-resistant coating layer formed on said flexible substrate, said water-resistant coating layer being composed of a water-insoluble resin binder comprising 5 to 45% by weight of a wax and 55 to 95% by weight of a water-insoluble resin, and dispersed in said binder, an inorganic pigment capable of being rendered hydrophilic by an etching treatment, said water-resistant coating layer including an oleophilic ink-supporting portion and an etched hydrophilic ink-repelling portion, wherein said oleophilic ink-supporting portion is formed by applying to said water-resistant coating layer magnetic developer particles comprising 100 parts by weight of triiron tetroxide, 10 to 150 parts by weight of a binder, and 1 to 20 parts by weight of carbon black, said developer particles consisting essentially of nuclear particles composed of said triiron tetroxide, said binder and a part of carbon black and the remainder of carbon black crumbed on the nuclear particles, and passing the water-resistant layer having the image of the developer particles thereon between a pair of rollers whereby the magnetic developer particles are tightly embedded in the water-resistant coating layer and the water-resistant coating layer is smoothened and rendered compact in said hydrophilic ink-repelling portion.

2. A plate as set forth in claim 1 wherein the water-resistant coating layer is composed of a homogeneous mixture of (A) water-insoluble resin binder and (B) a fine crystal of zinc oxide in which the mixing weight ratio of (A):(B) is in the range of from 1:10 to 4:10 and the water-resistant coating layer is smoothened and rendered compact by passing it through between a pair of press rollers.

3. A plate as set forth in claim 2 wherein the ink-repelling portion has a smoothness not higher than 60 mmHg (absolute) as measured by a vacuum micrometer type smoothness tester, and the compactness (R) of the ink-repelling portion defined by the following formula:

$$R = \frac{W_0 - W_1}{W_0} \times 100$$

wherein $W_0$ stands for the water-absorbing capacity ($g/m^2$) of the water-resistant layer at 20° C. before it is passed through between the press rollers and $W_1$ represents the water-absorbing capacity ($g/m^2$) of the water-resistant layer at 20° C. after it has been passed through the press rollers, is at least 10%.

4. A plate as set forth in claim 3 wherein the water-resistant layer is smoothened and rendered compact by passing it through between a pair of press rollers applying a linear pressure of at least 15 Kg per cm of the roller length.

5. A plate as set forth in claim 1 wherein the water-insoluble resin is at least one member selected from acrylic resins and alkyd resins.

* * * * *